US010758763B1

(12) United States Patent
Chen

(10) Patent No.: US 10,758,763 B1
(45) Date of Patent: Sep. 1, 2020

(54) ACCESSORY STRUCTURE TRAMPOLINE

(71) Applicant: Samuel Chen, Causeway Bay (HK)

(72) Inventor: Samuel Chen, Causeway Bay (HK)

( * ) Notice: Subject to any disclaimer, the term of this patent is extended or adjusted under 35 U.S.C. 154(b) by 0 days.

(21) Appl. No.: 16/417,942

(22) Filed: May 21, 2019

(51) Int. Cl.
*A63B 5/11* (2006.01)
*A45F 3/24* (2006.01)

(52) U.S. Cl.
CPC ..... *A63B 5/11* (2013.01); *A45F 3/24* (2013.01); *A63B 2210/50* (2013.01)

(58) Field of Classification Search
CPC ..... A63B 5/11; A63B 2210/50; A45F 3/24
See application file for complete search history.

(56) References Cited

U.S. PATENT DOCUMENTS 2,534,019 A * 12/1950 Griswold ..... A47C 17/68 482/28
3,116,809 A * 1/1964 Nissen ..... A63B 5/11 482/28
3,501,141 A * 3/1970 Nissen ..... A63B 5/11 482/29
3,593,352 A * 7/1971 Britt ..... A45F 3/24 5/127
3,977,122 A * 8/1976 Meyer ..... A63H 13/12 446/268
4,045,021 A * 8/1977 Nissen ..... A63B 5/11 482/29
4,284,271 A * 8/1981 Pettit ..... A63B 5/11 182/139
4,337,942 A * 7/1982 Sidlinger ..... A63B 5/11 482/142
4,483,531 A * 11/1984 Laseman ..... A63B 5/11 482/27
5,007,638 A * 4/1991 Yukl ..... A63B 69/0097 273/395
5,533,948 A * 7/1996 Wilkinson ..... A63B 5/11 482/146
5,613,922 A * 3/1997 Hsiang ..... A63B 69/0097 108/8
5,634,870 A * 6/1997 Wilkinson ..... A63B 5/11 482/27
5,645,510 A * 7/1997 Wilkinson ..... A63B 5/11 482/27

(Continued)

FOREIGN PATENT DOCUMENTS

GB 2461335 A * 1/2010 ..... E04H 1/1205

*Primary Examiner* — Nyca T Nguyen
(74) *Attorney, Agent, or Firm* — Clement Cheng

(57) ABSTRACT

An accessory structure trampoline has a main trampoline with a main trampoline bed, main trampoline springs, and a main trampoline spring cover. The main trampoline includes trampoline legs having a first vertical leg section and a second vertical leg section. An accessory structure is pivotally mounted to the first vertical leg section and the second vertical leg section. The accessory structure folds from a deployed position to a stowed position. The accessory structure can be a small trampoline that is smaller than the main trampoline. The small trampoline folds from a deployed position to a stowed position. The small trampoline has a fold-down handlebar and folding legs, and the fold-down handlebar folds from a deployed position to a stowed position. The accessory structure can also be a hammock swing. The hammock swing folds from a deployed position to a stowed position.

4 Claims, 4 Drawing Sheets

(56) References Cited

U.S. PATENT DOCUMENTS 5,674,157 A * 10/1997 Wilkinson ..... A63B 5/11 482/27
5,788,606 A * 8/1998 Rich ..... A63B 69/0064 482/27
5,833,234 A * 11/1998 Vavala ..... A63B 69/0097 473/434
5,947,870 A * 9/1999 Hall ..... A63B 5/11 482/27
6,135,922 A * 10/2000 Nissen ..... A63B 5/11 482/27
6,599,221 B1 * 7/2003 Goldwitz ..... A63B 5/11 482/27
7,094,181 B2 * 8/2006 Hall ..... A63B 5/11 482/27
7,481,740 B2 1/2009 Colling
7,909,738 B2 * 3/2011 Chen ..... A63B 5/11 114/264
8,177,651 B2 * 5/2012 Curry ..... A63B 65/06 273/395
8,657,696 B1 * 2/2014 Gurley ..... A63B 5/11 472/92
D718,827 S * 12/2014 Chen ..... A63B 5/11 D21/797
9,039,573 B2 * 5/2015 Smock ..... A63B 5/11 482/27
9,084,908 B1 * 7/2015 Chen ..... A63B 5/11
9,301,562 B1 * 4/2016 Chen ..... A41D 19/0027
9,446,274 B1 * 9/2016 Chen ..... A63B 21/023
10,076,697 B1 * 9/2018 Publicover ..... A63B 71/0054
2003/0060309 A1 * 3/2003 Smith, IV ..... A63B 69/0002 473/431
2003/0185614 A1 * 10/2003 Motamed ..... B65H 31/14 400/718
2005/0043142 A1 * 2/2005 Rieber ..... A63B 5/11 482/27
2005/0251910 A1 * 11/2005 Boyd ..... A45F 3/22 5/120
2006/0058123 A1 3/2006 Publicover
2006/0105852 A1 * 5/2006 Curry ..... A63B 65/06 473/219
2006/0189443 A1 * 8/2006 Finlinson ..... A63G 21/04 482/29
2006/0223676 A1 * 10/2006 Rote ..... A63B 5/11 482/27
2007/0010374 A1 * 1/2007 Widich ..... A63B 5/11 482/27
2007/0066447 A1 3/2007 Overholt
2010/0041519 A1 * 2/2010 Law ..... A63B 71/023 482/27
2011/0021321 A1 * 1/2011 Legg ..... A63B 5/11 482/29
2011/0287899 A1 * 11/2011 West ..... A63C 19/02 482/27
2012/0142499 A1 * 6/2012 Ikegami ..... A63B 5/11 482/27
2013/0210590 A1 * 8/2013 Publicover ..... A63B 69/0097 482/110
2013/0225304 A1 * 8/2013 Hsieh ..... A63G 31/007 472/118
2013/0310223 A1 * 11/2013 Canales ..... A63B 5/11 482/27
2014/0005003 A1 * 1/2014 Howell ..... A63B 5/11 482/27
2014/0080674 A1 * 3/2014 Chen ..... A63G 9/14 482/29
2014/0135178 A1 * 5/2014 Smock ..... A63B 5/11 482/27
2015/0051057 A1 * 2/2015 Carter ..... A63B 21/00054 482/142
2016/0256722 A1 * 9/2016 Tsai ..... A63B 5/11
2017/0113090 A1 * 4/2017 Wilson ..... A63B 21/0125
2017/0203174 A1 * 7/2017 Chen ..... A63B 71/022
2017/0340939 A1 11/2017 Chen
2018/0193684 A1 * 7/2018 Jamesapollos ..... A63B 21/16
2020/0029716 A1 * 1/2020 Guillot ..... A47C 9/002

* cited by examiner

ACCESSORY STRUCTURE TRAMPOLINE

FIELD OF THE INVENTION

The present invention is in the field of trampolines.

DISCUSSION OF RELATED ART

A wide variety of trampoline accessories have been provided for increased functionality of trampolines.

Like trampolines, soccer is also a popular backyard sport. For example, in the U.S. Pat. No. 7,481,740B2, Trampoline Accessories by inventor Michael J. Colling, published Jan. 27, 2009, the abstract discloses, "Trampoline accessories are described herein that may be affixed to a trampoline system to facilitate the playing of a game. These trampoline accessories may include a soccer net, a rebounding surface that will bounce a ball back to the thrower, and a catch panel that will gather the ball when the ball is thrown against the panel. These accessories may be added to either the trampoline frame of the trampoline enclosure. Deflective netting may be provided adjacent the accessories to prevent the ball and users from entering the space below the trampoline rebounding mat."

Trampolines can also incorporate basketball. For example, in the United States patent publication number US2006/0058123A1, entitled Basketball Hoop And Backboard For A Trampoline by inventor Mark W. Publicover, published May 16, 2006, the abstract discloses, "A padded basketball hoop is flexibly mounted to a backboard or other rigid vertical surface via an energy or shock absorbing connection device disposed between the backboard and the vertical surface supporting the hoop. The hoop responds to upward and downward vertical displacement by transferring energy to the shock absorbing connector, wherein the absorbing connector then urges said hoop to a substantially horizontal orientation. The hoop is particularly useful connection with play on a trampoline or other instances where players are likely to connect the rim during upward." Also for example, in the U.S. Pat. No. 9,084,908, entitled Trampoline Basketball Goal also by inventor Samuel Chen, published Jul. 21, 2015, the abstract discloses, "The trampoline basketball goal includes a frame, a bed and springs connecting the bed to the frame. The trampoline enclosure includes enclosure poles holding an enclosure net. The enclosure poles have an upper end and a lower end. The enclosure poles comprise a first enclosure pole, a second enclosure pole, and a third enclosure pole. The first enclosure pole, the second enclosure pole, and the third enclosure pole are placed around a periphery of the trampoline bed. The first trampoline pole is adjacent to the second trampoline pole, and the second trampoline pole is adjacent to the third trampoline pole. A basketball backboard is suspended between the first and third enclosure poles."

Trampolines can also incorporate water spray. For example, in the United States patent publication number US2007/0066447A1, entitled Trampoline Accessory by inventor Chad E. Overholt, published May 27, 2007, the abstract discloses, "A trampoline accessory having a water conduit and water conduit securing means for securing the water conduit to the mat of a trampoline. The water conduit has a water supply inlet and a plurality of water discharging outlets. The water supply inlet is preferably of a first diameter, and the water discharging outlets are preferably of a second diameter, with the first diameter being greater than the second diameter. The water supply inlet preferably includes a diverter, with the diverter creating at least two flow paths. The trampoline securing means may be selected from a group which includes cable ties, cooperative hook and loop straps, grommets, fabric straps, plastic straps, belts, snaps, clasps, and clips. The water conduit itself is preferably fabricated having a hose connector and a hose. As so fabricated, the hose has at least one fitting, with the fitting engaging the hose connector. In the preferred embodiment, the hose has two fittings, with each of the fittings engaging the hose connector. The fitting and the hose connector preferably are formed have cooperating male and female connections."

Trampolines can also incorporate an overhead target such as a piñata. For example, in the United States patent publication number US2017/0340939A1, entitled Suspended Target Trampoline Game by inventor Samuel Chen, published Nov. 30, 2017, the abstract discloses, "A suspended target trampoline game includes a trampoline having a trampoline frame which includes a trampoline leg supporting the trampoline frame, and an enclosure. The enclosure includes an enclosure pole connected to the trampoline frame. The enclosure pole supports an enclosure net. An overhanging pole is connected to the enclosure pole. A line is suspended from the overhanging pole. A target is suspended from the line. A detachable connection can be formed between the target and the line. The detachable connection releasably attaches the target to the line. A slack control mechanism can adjust a height of the target. The target can be a ball."

SUMMARY OF THE INVENTION

An accessory structure trampoline has a main trampoline with a main trampoline bed, main trampoline springs, and a main trampoline spring cover. The main trampoline includes trampoline legs having a first vertical leg section and a second vertical leg section. An accessory structure is pivotally mounted to the first vertical leg section and the second vertical leg section. The accessory structure folds from a deployed position to a stowed position. The accessory structure can be a small trampoline that is smaller than the main trampoline. The small trampoline folds from a deployed position to a stowed position. The small trampoline has a fold-down handlebar and folding legs, and the fold-down handlebar folds from a deployed position to a stowed position. The accessory structure can also be a hammock swing. The hammock swing folds from a deployed position to a stowed position.

The hammock assembly has a hammock beam, wherein hammock beam is hinged to a hammock outside frame at a hammock outside top hinge. The hammock inside frame is hinged at a hammock inside top hinge to a hammock inside frame. The hammock inside frame can be hinged to the first vertical leg section at a first hammock inside frame hinge and to a second vertical leg section at a second hammock inside frame hinge.

The following call out list of elements can be useful guide in referencing the element numbers of the drawings.

20 Main Trampoline
21 First Bed
22 First Spring Cover
23 Leg
24 Enclosure Pole Cover
25 Enclosure Pole
26 Enclosure Upper Connector
27 Enclosure Line
28 Enclosure Net
29 Springs
30 Auxiliary Trampoline
31 Second Bed
32 Second Spring Cover
41 First Vertical Leg Section
42 Second Vertical Leg Section
43 Footing Section
44 Right Pivot Joint
45 Left Pivot Joint
50 Handle
51 First Handle Joint
52 Second Handle Joint
53 Handle Cover
54 Folding Leg
55 Folding Leg Joint
60 Hammock Assembly
61 Hammock Outside Top Hinge
62 Hammock Inside Top Hinge
63 Hammock Outside Frame Footing
64 Hammock Outside Frame
65 Hammock Seat
66 Hammock Inside Frame
67 First Hammock Inside Frame Hinge
68 Second Hammock Inside Frame Hinge
69 Hammock Beam

DETAILED DESCRIPTION OF THE PREFERRED EMBODIMENT

Figure 1:
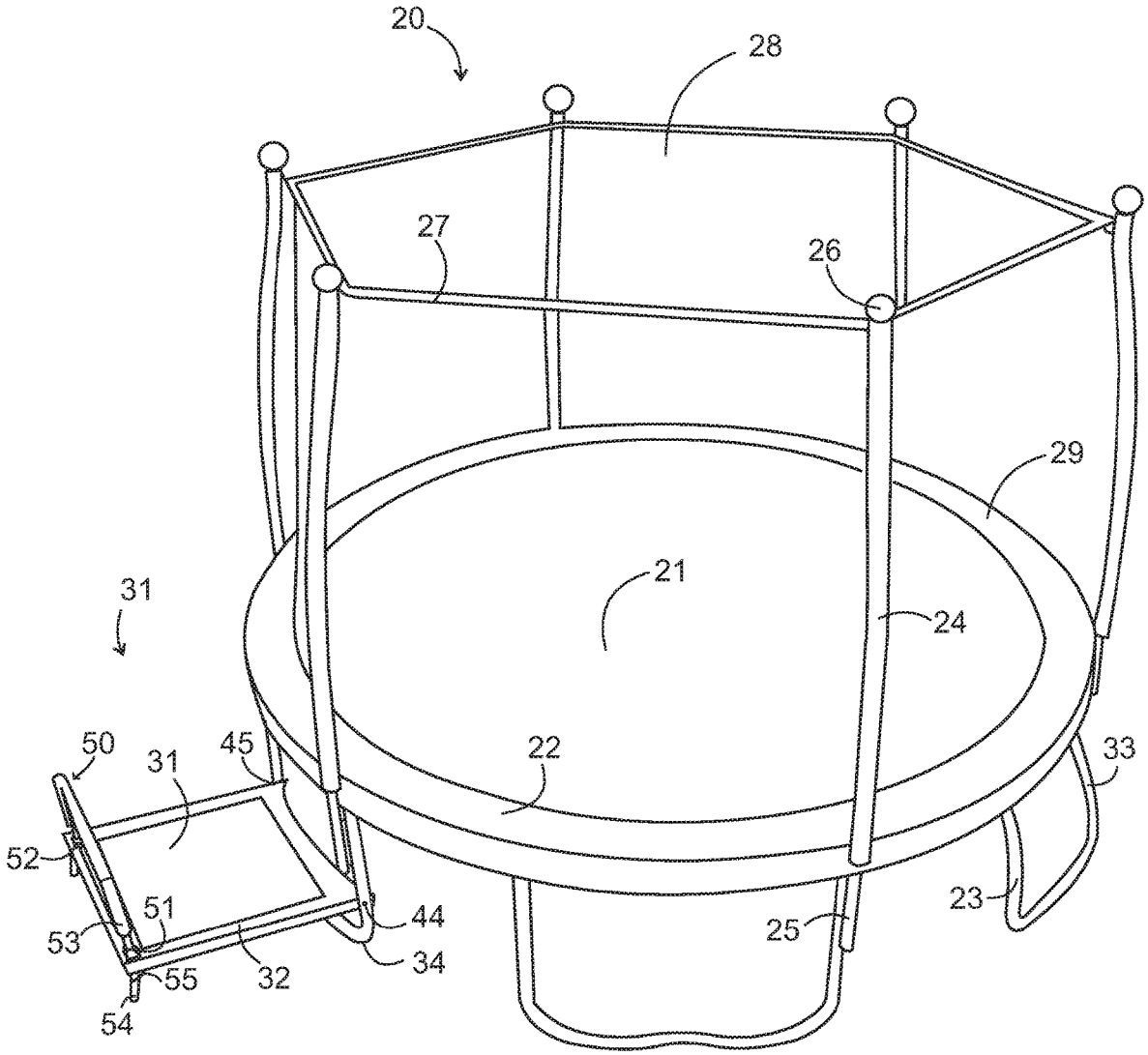
FIG. 1 is a diagram of a trampoline with an accessory structure side trampoline.

As seen in FIG. 1, a main trampoline 20 has one or more accessory structures. A first bed 21 of the main trampoline 20 can be for a larger trampoline such as a 14 foot diameter trampoline. The first bed 21 is suspended by springs 29 and the springs 29 are covered by a first spring cover 22. The springs are extended across the first trampoline frame and the trampoline frame is supported by legs 23.

Enclosure poles 25 extends upwardly from the trampoline frame and are connected to the legs 23. The tops ends of the trampoline poles have trampoline pole upper connectors 26 that connect to an enclosure line 27. The enclosure line 27 supports the enclosure net 28 and the enclosure net is draped from the enclosure line 27. The trampoline enclosure poles 25 preferably have enclosure pole covers 24. The enclosure upper connector 26 can be formed as a ball.

A small child that wishes to play on a trampoline can use the second bed 31 which also has a second spring cover 32. The second bed 31 is formed at a lower elevation than the elevation of the first bed 21. The second bed 31 is mounted on a frame that is connected to a trampoline joint right pivot joint 44 and a left pivot joint 45 to allow pivoting of the second bed 31 from a deployed position to a stowed position.

A handle 50 of the auxiliary trampoline 30 accessory structure can pivot from a deployed position to a stowed position. The handle 50 is mounted to a first handle joint 51 and a second handle joint 52 of the accessory structure frame. A handle cover 53 is preferably included as a grip for user stability during jumping on the accessory structure. A folding leg 54 of the accessory structure can fold from a deployed position to a stowed position at a folding leg joint 55. Preferably, the folding leg joint 55 is a hinge that hinges the folding leg 54 to the accessory structure frame.

Figure 4:
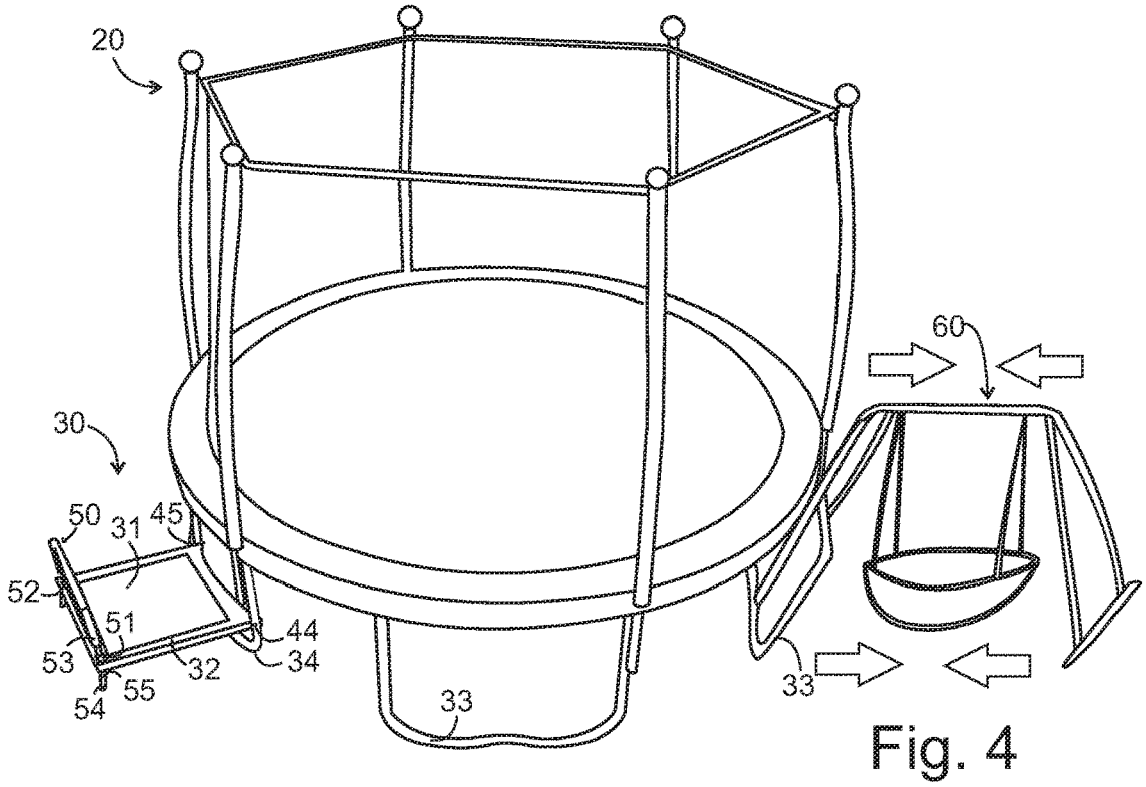
FIG. 4 is a diagram of a trampoline with an accessory hammock swing.

Some legs of the trampoline can extend outwardly away from the trampoline bed, but some legs can extend inwardly underneath the trampoline frame. For example, outwardly extending legs 33 can be alternated with inwardly extending legs 34. The accessory can be mounted on an inwardly extending leg 34 such as seen in FIG. 1 or the accessory can be mounted on an outwardly extending leg as seen in FIG. 4. The trampoline legs can be inwardly extending, outwardly extending or straight, however it is preferred that the trampoline legs are outwardly extending.

Figure 2:
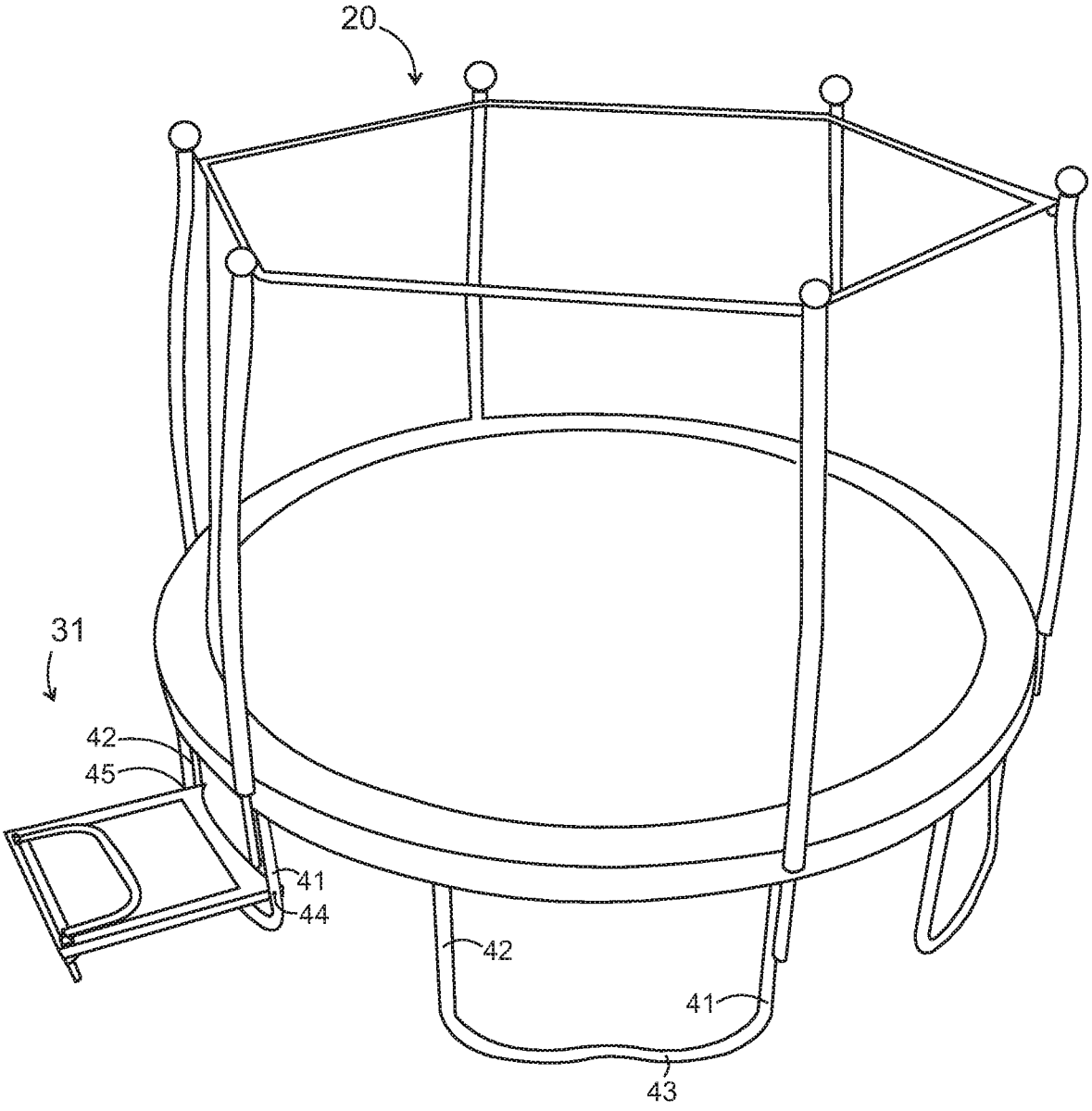
FIG. 2 is a diagram of the folding handle and legs of the side trampoline.

As seen in FIG. 2, the trampoline leg 23 has a first vertical leg section 41 and a second vertical leg section 42 that are connected together at a footing section 43. The first vertical leg section 41 supports a right pivot joint 44 and the second vertical leg section 42 supports the left pivot joint 45.

Figure 3:
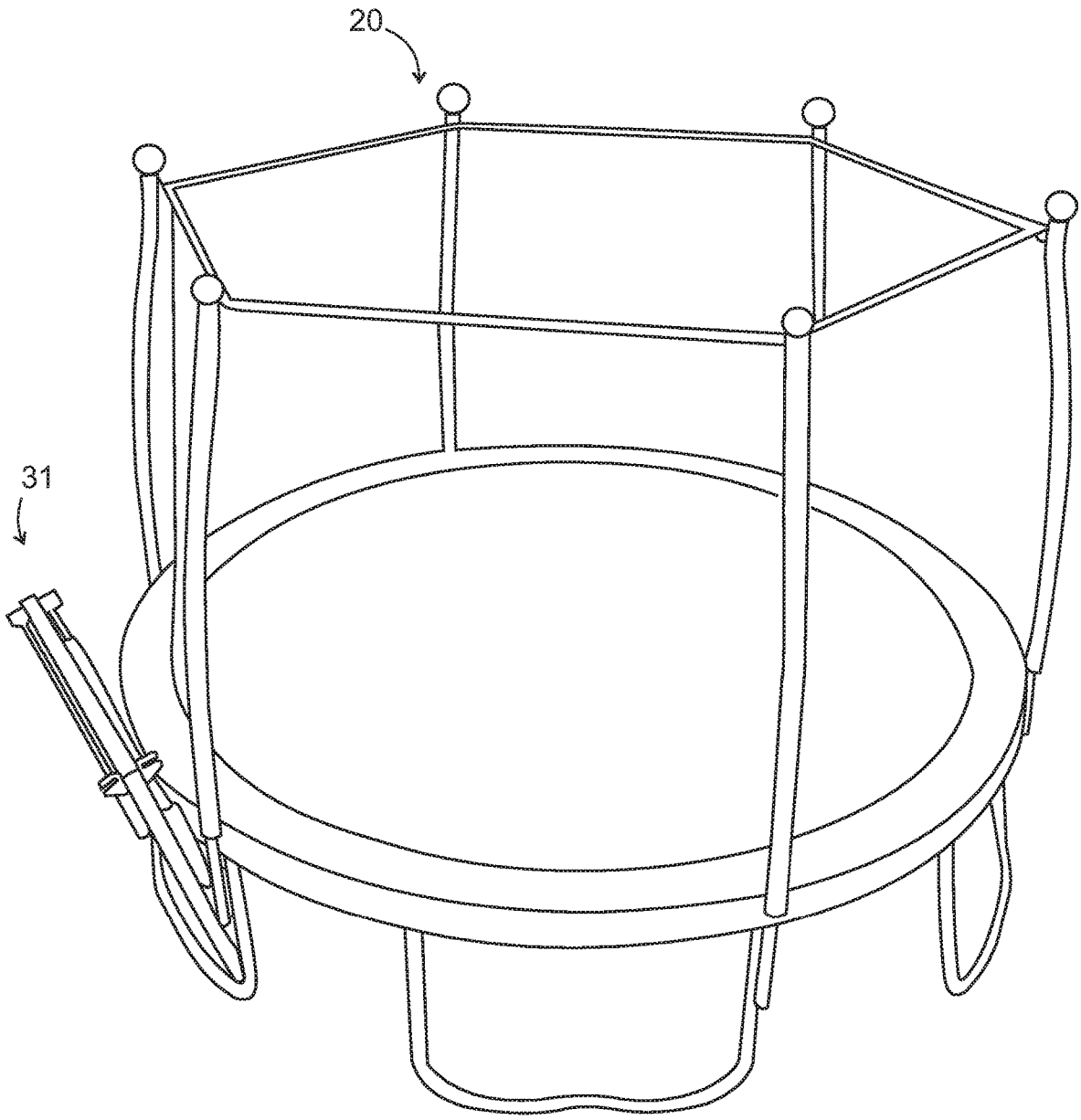
FIG. 3 is a diagram of the folded side trampoline in stowed position.

As seen in FIG. 3, the accessory structure trampoline can be stowed in a folded position. As seen in FIG. 4, the accessory structure can be formed as a hammock swing with a round pouch like hammock that has a frame connected to the first vertical leg section 41 and the second vertical leg section 42. Similar to the small trampoline accessory structure, the hammock swing accessory structure can also fold.

Figure 5:
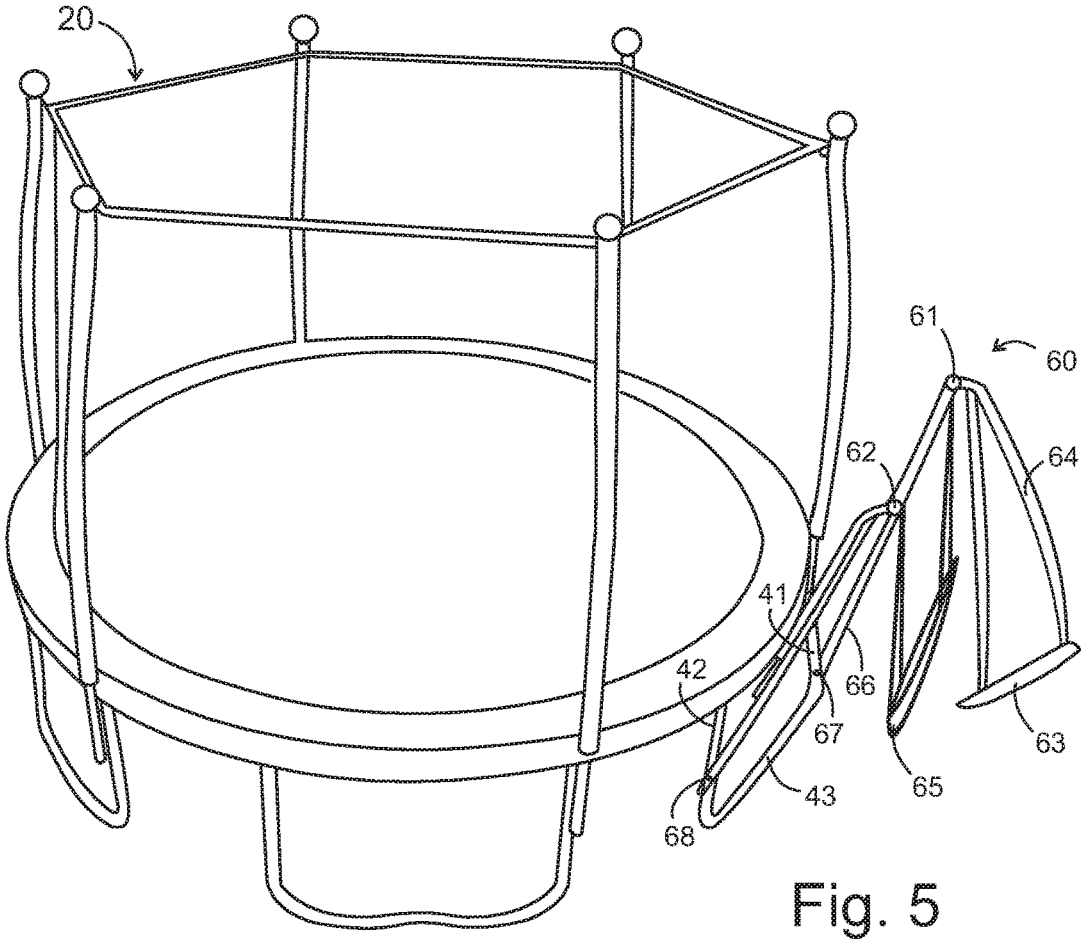
FIG. 5 is a diagram of a trampoline with a folding accessory hammock swing.

As seen in FIG. 5, the accessory structure can be made foldable, such as with jointed or telescopic members. A pair of accessory structures can be implemented with a small trampoline on a left side connected to the large main trampoline and a hammock swing on a right side. Also as seen in FIG. 5, the hammock assembly 60 can also fold up. The first vertical leg section 41 is jointed to the first hammock inside frame hinge 67, and the second hammock inside frame hinge 68 is mounted to the second vertical leg section 42. The footing section 43 connects the first vertical leg section 41 to the second vertical leg section 42. The hammock assembly 60 has a hammock beam 69 from which the hammock seat 65 is suspended. The hammock beam 69 has a hammock outside top hinge 61 and a hammock inside top hinge 62. The hammock beam 69 is thus hinged to the hammock inside frame 66 via the first hammock inside frame hinge 67 and the second hammock inside frame hinge 68. The hammock outside frame 64 is hinged to the hammock beam 69 at a hammock outside top hinge 61 so that they fold from a perpendicular to a more parallel configuration. The hammock outside frame 64 has a hammock outside frame footing 63. The hammock beam 69 can be made in a double tube configuration either side by side or vertically stacked to allow a four bar mechanism option.

The invention claimed is:

1. An accessory structure trampoline comprising:

a. a main trampoline having a main trampoline bed, main trampoline springs, and a main trampoline spring cover, wherein the main trampoline further including trampoline legs having a first vertical leg section and a second vertical leg section;

b. an accessory structure pivotally mounted to the first vertical leg section and the second vertical leg section, wherein the accessory structure folds from a deployed position to a stowed position, wherein the accessory structure is a hammock assembly, wherein the hammock assembly folds from the deployed position to the stowed position, wherein the hammock assembly has a hammock beam, wherein the hammock beam is hinged to a hammock outside frame at a hammock outside top hinge, wherein the hammock beam is hinged at a hammock inside top hinge to a hammock inside frame.

2. The accessory structure trampoline of claim 1, wherein the hammock inside frame is hinged to the first vertical leg section at a first hammock inside frame hinge and to a second vertical leg section at a second hammock inside frame hinge.

3. An accessory structure trampoline comprising:

a. a main trampoline having a main trampoline bed, main trampoline springs, and a main trampoline spring cover, wherein the main trampoline for the includes trampoline legs having a first vertical leg section and a second vertical leg section;

b. an accessory structure pivotally mounted to the first vertical leg section and the second vertical leg section, wherein the accessory structure folds from a deployed position to a stowed position, wherein the accessory structure is a small trampoline that is smaller than the main trampoline, wherein the small trampoline folds from the deployed position to a stowed position by folding upwards;

c. an enclosure net mounted between the main trampoline and the small trampoline, wherein the small trampoline has a second bed that is horizontally oriented below the main trampoline bed when in the small trampoline is in a deployed position; and d. folding legs pivotally mounted on the small trampoline, wherein the folding legs fold with the small trampoline when the small trampoline is folded from the deployed position to the stowed position.

4. An accessory structure trampoline comprising:

a. a main trampoline having a main trampoline bed, main trampoline springs, and a main trampoline spring cover, wherein the main trampoline further including trampoline legs having a first vertical leg section and a second vertical leg section;

b. an accessory structure pivotally mounted to the first vertical leg section and the second vertical leg section, wherein the accessory structure folds from a deployed position to a stowed position, wherein the accessory structure is a small trampoline that is smaller than the main trampoline, wherein the small trampoline folds from the deployed position to the stowed position, wherein the small trampoline has a fold-down handlebar and folding legs, wherein the fold-down handlebar folds from a deployed position to a stowed position.

* * * * *